US005885046A

United States Patent [19]

Peek et al.

[11] Patent Number: 5,885,046

[45] Date of Patent: Mar. 23, 1999

[54] FOUR-WHEEL, DOUBLE BOGEY FOR A LANE BARRIER POSITIONING VEHICLE

[75] Inventors: Steven L. Peek, Elk Grove, Calif.; John W. Duckett, Carson City, Nev.

[73] Assignee: Barrier Systems, Inc., Carson City, Nev.

[21] Appl. No.: 724,208

[22] Filed: Oct. 2, 1996

[51] Int. Cl.[6] ..... E01F 13/00

[52] U.S. Cl. ..... 414/460; 404/73

[58] Field of Search ..... 414/459, 460; 404/6, 9, 12, 13, 73

[56] References Cited

U.S. PATENT DOCUMENTS

| | | | |
|---|---|---|---|
| 2,182,697 | 12/1939 | Jelinek . | |
| 2,287,685 | 6/1942 | Jelinek . | |
| 2,931,279 | 4/1960 | Wiswell . | |
| 4,017,200 | 4/1977 | Woods, Jr. . | |
| 4,119,210 | 10/1978 | Desourdy | 414/460 |
| 4,474,503 | 10/1984 | Booth et al. . | |
| 4,498,803 | 2/1985 | Quittner . | |
| 4,500,225 | 2/1985 | Quittner . | |
| 4,624,601 | 11/1986 | Quittner . | |
| 4,653,954 | 3/1987 | Booth et al. | 404/6 |
| 4,806,044 | 2/1989 | Duckett . | |
| 4,815,889 | 3/1989 | Duckett . | |
| 4,828,425 | 5/1989 | Duckett . | |
| 4,881,845 | 11/1989 | McKay . | |
| 4,955,753 | 9/1990 | McKay . | |
| 5,074,704 | 12/1991 | McKay . | |
| 5,088,874 | 2/1992 | Quittner | 414/460 |
| 5,246,305 | 9/1993 | Peek | 404/6 |
| 5,253,951 | 10/1993 | Peek | 404/9 X |

FOREIGN PATENT DOCUMENTS

| | | | |
|---|---|---|---|
| 1948051 | 4/1971 | Germany | 414/460 |

*Primary Examiner*—James W. Keenan
*Attorney, Agent, or Firm*—Finley & Berg, LLP

[57] ABSTRACT

Disclosed is a double bogey arrangement comprised of four wheels mounted in an opposed fashion for supporting the T-shaped upper end of a road lane barrier. The double bogey structure includes an elastomeric mounting to absorb operating shocks while transferring lane barriers from one lane to another. The four-wheel bogey precludes problems existing with present lane barrier positioning vehicles wherein the support wheels are caught in the separation between the series of lane barriers, thereby causing damage to the support wheels and to the lane barriers.

5 Claims, 3 Drawing Sheets

FOUR-WHEEL, DOUBLE BOGEY FOR A LANE BARRIER POSITIONING VEHICLE

BACKGROUND OF THE INVENTION

This invention relates to the support member for the T-shaped lane dividers utilized with a lane barrier positioning vehicle. In particular, it relates to the suspension member which holds the lane barrier off the surface of the road while it is shifted from one lane to another.

In the last several years, it has become apparent that the positioning of lane barriers on major highways can drastically reduce head-on collisions. However, because of their nature, the lane barriers in their normal configurations are difficult to move from one lane to another to change the number of traffic lanes flowing in one direction. This situation is particularly apparent where the majority of the traffic will flow in one direction in the morning and in the opposite direction in the afternoon.

A lane barrier positioning vehicle is disclosed in U.S. Pat. No. 4,500,225, which serves to reposition lane barriers from one lane to another. This vehicle is used with a specially-configured barrier having a T-shaped cross-section at the top ad described in U.S. Pat. No. 4,500,225. The vehicle has a series of rollers mounted beneath the vehicle which are in an S-shaped track so that a lane barrier can be picked up at the front of the vehicle and, as the vehicle moves forward, the lane barrier is picked off the road and shifted laterally to either the right or the left of the vehicle as it traverses the highway. The distance of traverse is calculated to be equal to one lane. As a consequence, after the lane barrier positioning vehicle has passed down a multilane highway, the lane barrier separating the oncoming traffic has been shifted one lane either to the left or right so that the number of active lanes traveling in one direction is increased, while the number of lanes in the opposite direction is commensurately decreased.

This system is in use on several major bridges in the United States, as well as in other countries.

The T-shaped lane barrier is supported in the vehicle by a number of rollers that are independently suspended below the vehicle. In more recent versions, each roller may be separately suspended from the vehicle by a spring-loaded member. It should be noted that the rollers are situated opposite one another so that there are pairs of rollers that support the T-shaped head of the lane barrier. In order for the lane barrier to be shifted from one lane to another, the barrier is made in sections and jointed between each section. Thus, when the lane is shifted from right to left as it passes under the vehicle in an S-shaped pattern, each section is shifted laterally. The separation between the section is kept as close as possible; however, it has been found that the independently suspended support wheels on some occasion will "hang up" in the joint between the two lane barrier sections. While the momentum in the vehicle is generally sufficient to jar the offending wheel out of the separation, there is usually some residual damage to the lane barrier and to the support wheel. After a series of uses, the support wheel must be changed and it may become necessary for the lane barrier to be changed.

It is an object of this invention to overcome this handicap by providing better support for the support wheels affixed to the lane barrier positioning vehicle.

It is a further object of this invention to improve the mounting of the support wheels under the vehicle so that there is less damage to the lane barrier and to the wheels supporting the lane barrier.

This invention comprises a double bogey support member formed of a U-shaped bracket defining a pair of downwardly extending legs and a cross-member interconnecting the downwardly extending legs. Two pairs of bogey wheels are included so that a first pair of wheels are rotatably affixed to one downwardly extending leg, and extend inwardly therefrom, and a second set of bogey wheels is rotatably affixed to the other downwardly extending legs, and extend inwardly therefrom. A resilient structure is provided to affix the cross-member of the U-shaped bracket to the lane barrier positioning vehicle so that the two pairs of bogey wheels can engage and support the lower surface of the T-shaped head of the lane barrier.

DETAILED DESCRIPTION OF A PREFERRED EMBODIMENT

Figure 1:
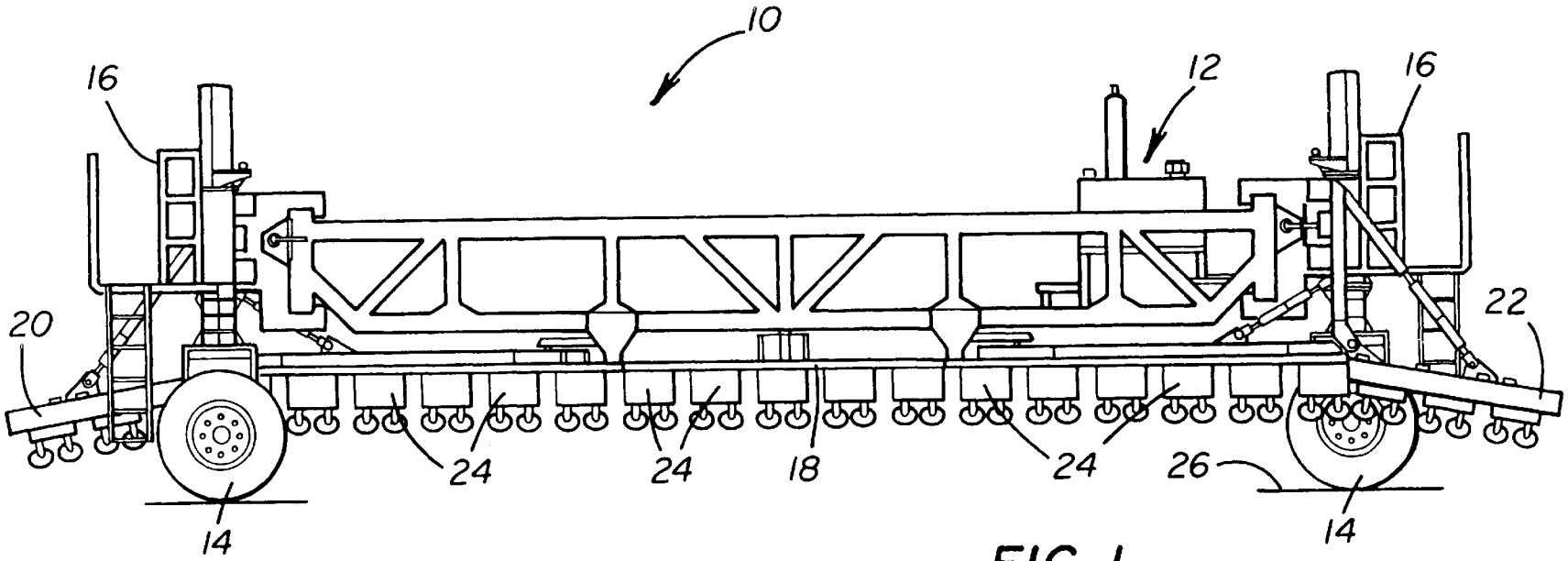
FIG. 1 is a side view of a lane barrier positioning vehicle incorporating the invention disclosed herein.

Referring to FIG. 1, a lane barrier positioning vehicle is shown. Vehicle 10 includes a propulsion engine 12 used to power the wheels 14 of vehicle 10. Control of the vehicle, which is operable in either direction, may be at a control station 16 located at the ends of the vehicle. Located under vehicle 10 is an S-shaped plate member 18 which has the configuration shown in FIG. 1A in a schematic arrangement. Plate member 18 is affixed to the underside of vehicle 10 and has extending at either end thereof extensions 20 and 22. Affixed to plate 18 and extensions 20 and 22 are a plurality of four-wheel double bogeys 24. It can be seen that the extensions 20 and 22 extend downwardly approaching the road level 26. This is purposely done so that a lane barrier shown in phantom in FIG. 2 can be engaged and lifted from the surface of the highway 26. As the vehicle moves along the lane barrier, it is picked up as described above and traverses the s-pattern shown in FIG. 1A so that when it reaches the extension at the opposite end, it is lowered back to the surface of the highway and displaced one lane width to the opposite side of the vehicle.

Figure 2:
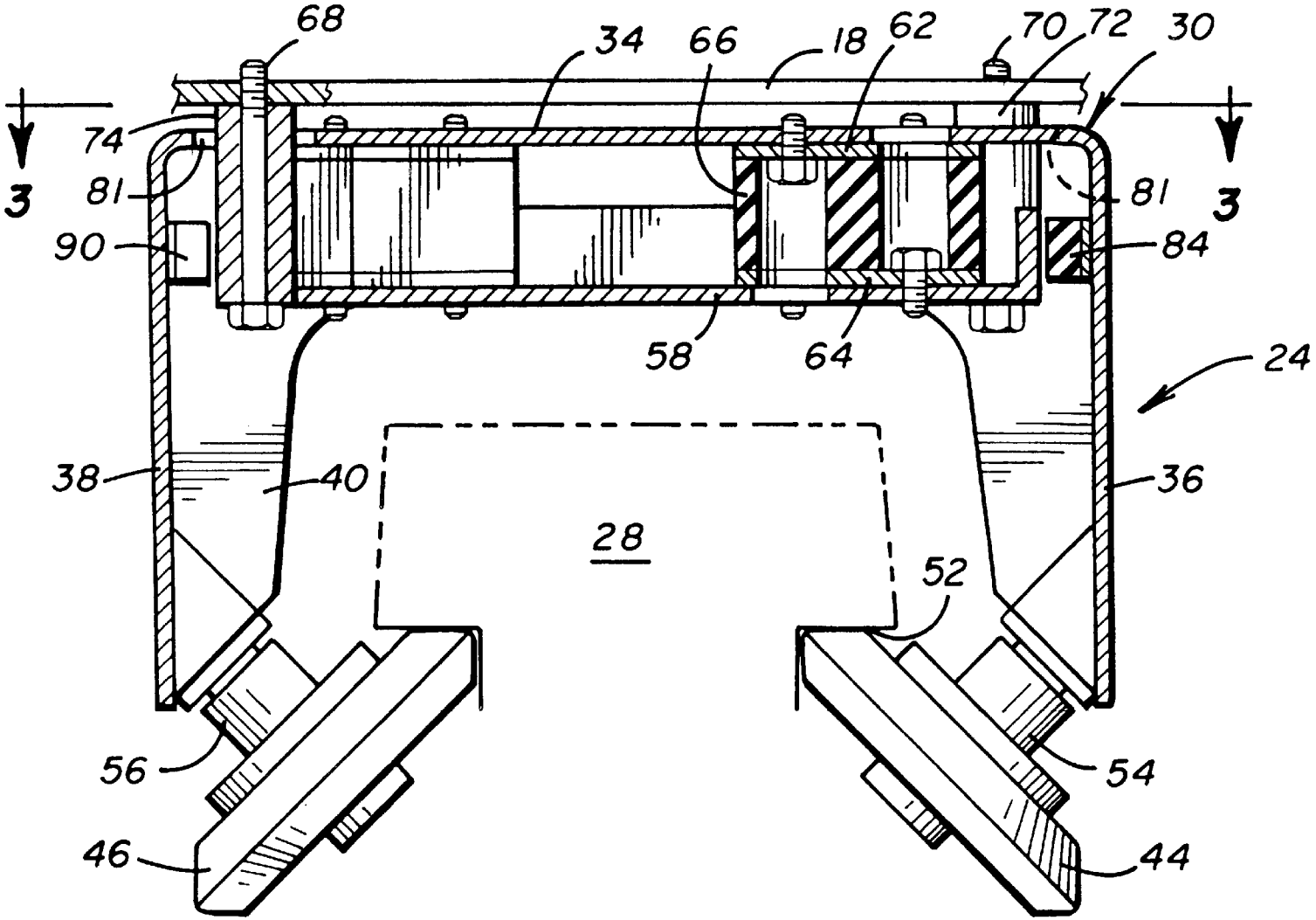
FIG. 2 is a cross-section of a double bogey wheel taken at section line 2—2 of FIG. 1.
Figure 3:
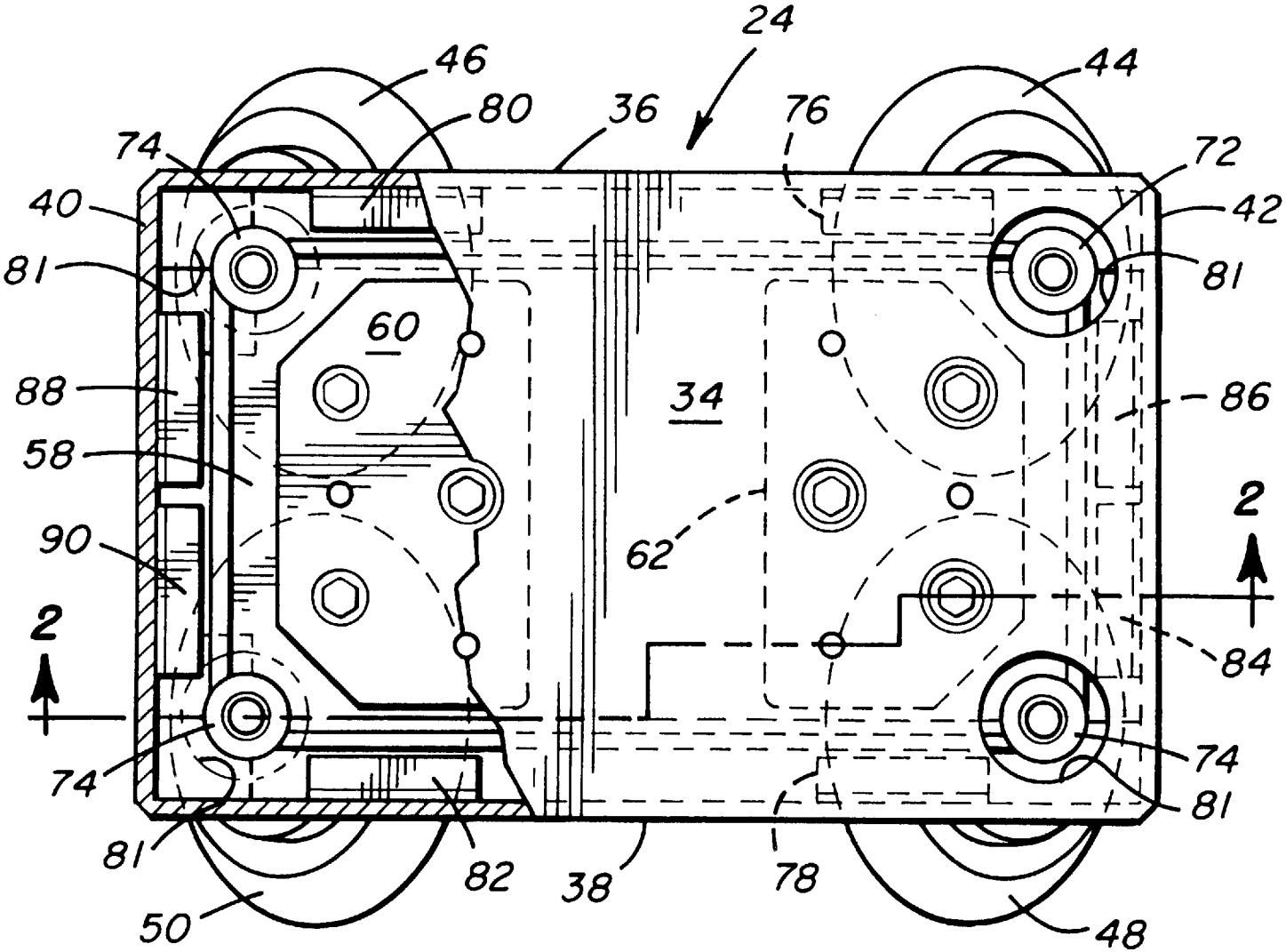
FIG. 3 is a top view of the double bogey shown in FIG. 2, taken at section line 3—3 of FIG. 2.

Referring now to FIG. 2, a cross-section of the double bogey is shown. FIG. 2 should be looked at in conjunction with FIG. 3, which is a top section of the same bogey. Each double bogey 24 consists of a U-shaped bracket 30 having a cross-member 34 and two downwardly extending legs 36 and 38. End pieces 40 and 42 are the interconnecting members at the ends of the U-shaped member 30 adding structural support thereto. There are two pairs of support wheels, the first pair being wheels 44 and 46 affixed to downwardly extending leg 36, and the second pair being wheels 48 and 50 affixed to downwardly extending leg 38. Reference to FIG. 2 will show that these wheels are affixed respectively to the downwardly extending legs 36 and 38 as they extend inwardly therefrom to support the undersurface of the T-shaped top of the barrier 28. It can be seen that the surface of the wheels 44 and 48, and in like manner, wheels 46 and 50, are configured such that one surface contacts the undersurface 52 of barrier 28. These wheels are mounted to the sidewalls of legs 36 and 38 through appropriate bearings 54 and 56. The wheel surfaces are preferably of a urethane material to reduce wear and tear on the barrier 28.

U-shaped bracket 30 is affixed to the plate member 18 by a unique resilient attachment which consists of a lower plate 58 and a pair of upper plates 60 and 62. A second plate member 64 may be positioned adjacent plate 58. Sandwiched between plate members 62 and 64 is a resilient member 66 made of elastomeric material. Bolts 68 and 70 pass through the lower plate member 58 and extend through hollow columns 72 and 74. The hollow columns 72 and 74 which are rigidly attached to lower plate member 58 and like columns on the opposite end also attached to plate member 58 (see FIG. 2) extend through holes 81 in the U-shaped bracket 30 and abut against the plate 18 which forms a portion of the vehicle.

Resilient members 76, 78, 80, 82, 84, 86, 88, and 90 are affixed to the U-shaped member of the support 40 to dampen lateral movement of the U-shaped member relative to the frame 18.

In use, the plurality of double-wheel bogeys are affixed to plate 18 in the manner described in relation to FIG. 1 so that barriers can be moved from one position to another by traversing down the lane structure and picking up the barriers 28 that have a T-shaped head. The bracket 30 is affixed to plate 18 such that the resilient member 66 is in compression with no load on the wheels 44 and 48. This is accomplished by appropriate torquing of the bolts 68 and 70, and the corresponding bolts at the opposite end of the double-wheel bogey so that the desired torque is obtained.

Figure 1A:
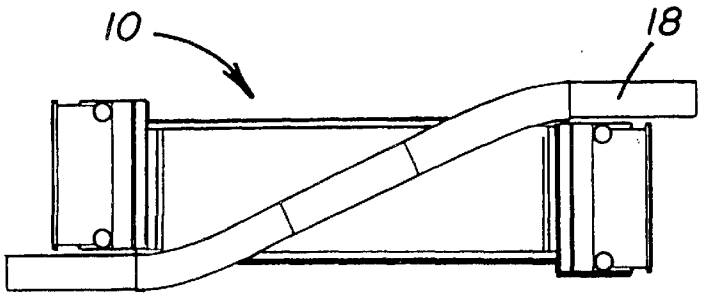
FIG. 1A is a schematic of the track mechanism located in vehicle 10 shown in FIG. 1.

In operation, the vehicle traverses the lane barriers, engaging the lower surface 52 of each individual barrier section 28 with the appropriate bogey wheels 44 and 48. As the vehicle traverses down the highway, the lane barrier is picked up and moved transversely to the vehicle's line of direction. At the same time, the wheels 44 and 48 are effectively prevented from being drawn into the separation between barrier ends because of the nature of the four-wheel bogey. Thus, as the wheels 44 and 48 traverse one end of a section of a barrier, the wheels 46 and 50 are still in engagement with the barrier. Wheels 46 and 50 remain in engagement with the barrier until wheels 44 and 48 have come into contact and engagement with the barrier just upstream of the one wheels 46 and 50 are engaged with. It is to be understood that there is a certain amount of play built into the machine between the wheels and the barrier 28 so that, as the barrier is shifted through the S-shaped track as shown in FIG. 1A, it will not bind in the wheels. The U-shaped bogey, being resiliently mounted to the vehicle as shown in FIG. 2, can operate independently of the other four-wheel bogeys yet retain a certain degree of rigidity necessary for the operation of the machine.

While this invention has been described with relation to a particular embodiment, it is not to be considered so limited, but only as limited as the following claims.

What is claimed is:

1. In combination with a vehicle for positioning lane barriers, the lane barriers having a T-shaped head with an upper and lower surface, a double bogey support member comprising:

a first U-shaped bracket defining a pair of downwardly extending legs and a cross-member interconnecting said downwardly extending legs, said cross member having an inner surface extending between said downwardly extending legs;

two pairs of bogey wheels, a first pair of said bogey wheels rotatably affixed to one downwardly extending leg of the first U-shaped bracket and extending inwardly therefrom, and the second pair of said bogey wheels rotatably affixed to the other downwardly extending leg of the U-shaped bracket and extending inwardly therefrom;

resilient means for affixing said cross-member of said U-shaped bracket to said lane barrier positioning vehicle, whereby said two pairs of bogey wheels can engage and support the lower surface of the T-shaped head of a lane barrier;

said resilient means including:

a rigid lower plate;

a pair of upper plates, said upper plates formed to about the inner surface of said cross-member;

a pair of elastomeric bumpers, one of said elastomeric bumpers separating said rigid lower plate from a first of said upper plates, and a second of said elastomeric bumpers separating said rigid lower plate from a second of said upper plates;

first attachment means for fixing said rigid lower plate to said vehicle, whereby said U-shaped bracket is resiliently attached to said vehicle.

2. The support member of claim 1 wherein the first attachment means includes columns rigidly affixed to said rigid lower plate and extending upwardly from said lower plate a distance greater than the thickness of said elastomeric bumpers, and sufficiently long to extend through the cross-member of said U-shaped bracket and abut against said vehicle; and, bolt means for passing through said columns for fixture to said vehicle.

3. The support member of claim 2 wherein the elastomeric bumpers are under compression with said U-shaped bracket affixed to said vehicle.

4. The support member of claim 3 further including bumper means affixed to said U-shaped bracket and extending inwardly therefrom, whereby said resilient means is prevented from contacting the legs of said U-shaped bracket.

5. The support member of claim 1 further including a pair of intermediate plates positioned between the elastomeric bumpers and the rigid lower plate.

* * * * *